US011946238B2

(12) United States Patent
Nguyen et al.

(10) Patent No.: US 11,946,238 B2
(45) Date of Patent: Apr. 2, 2024

(54) ADJUSTABLE FLUSH VALVE POPPET ASSEMBLY

(71) Applicants: Fluidmaster, Inc., San Juan Capistrano, CA (US); AS America, Inc., Piscataway, NJ (US)

(72) Inventors: Ken Nguyen, Huntington Beach, CA (US); Robert Jensen, East Brunswick, NJ (US); James Johnson, Lake Forest, CA (US)

(73) Assignees: Fluidmaster, Inc.; AS America, Inc.

( * ) Notice: Subject to any disclaimer, the term of this patent is extended or adjusted under 35 U.S.C. 154(b) by 75 days.

(21) Appl. No.: 17/668,016

(22) Filed: Feb. 9, 2022

(65) Prior Publication Data

US 2022/0170251 A1 Jun. 2, 2022

Related U.S. Application Data

(63) Continuation of application No. PCT/US2020/048311, filed on Aug. 28, 2020.

(60) Provisional application No. 62/893,683, filed on Aug. 29, 2019.

(51) Int. Cl.
*E03D 1/30* (2006.01)
*E03D 1/14* (2006.01)

(52) U.S. Cl.
CPC ..... *E03D 1/304* (2013.01); *E03D 1/14* (2013.01)

(58) Field of Classification Search
CPC ..... E03D 1/304; E03D 1/14
USPC ..... 4/378
See application file for complete search history.

(56) References Cited

U.S. PATENT DOCUMENTS

| | | | | |
|---|---|---|---|---|
| 1,712,605 | A | 5/1929 | Delany | |
| 3,368,224 | A | 2/1968 | Ament | |
| 3,701,169 | A | 10/1972 | Kamphausen | |
| 4,497,076 | A | 2/1985 | Sullivan | |
| 5,390,375 | A | 2/1995 | Fernstrum, Jr. | |
| 6,173,457 | B1 | 1/2001 | Higgins | |
| 8,122,526 | B2 * | 2/2012 | Li | E03D 1/306 4/393 |
| 8,196,898 | B1 * | 6/2012 | Huang | E03D 1/306 251/298 |
| 8,250,681 | B2 * | 8/2012 | Han | E03D 1/33 4/395 |
| 2003/0109144 | A1 * | 6/2003 | Goto | H01L 21/32135 438/689 |
| 2006/0195977 | A1 * | 9/2006 | Shieh | E03D 1/306 4/393 |

(Continued)

OTHER PUBLICATIONS

International Search Report dated Nov. 20, 2020 in corresponding International Application No. PCT/US2020/048311 (2 pages).

*Primary Examiner* — Huyen D Le
(74) *Attorney, Agent, or Firm* — Tyler A. Stevenson; Anna-lisa L. Gallo

(57) ABSTRACT

A modular poppet assembly system for a toilet tank flush valve assembly, the modular system comprising a first float portion; and two or more second float portions; wherein, the first float portion is configured to removably attach to each of the two or more second float portions to form two or more poppet assemblies, each of the two or more poppet assemblies comprise a different buoyancy, each of the two or more poppet assemblies allow the toilet tank to fill to substantially a same water volume, and as the poppet assembly buoyancy increases, an increase in flush volume is provided.

15 Claims, 2 Drawing Sheets

(56) References Cited

U.S. PATENT DOCUMENTS

| | | | | |
|---|---|---|---|---|
| 2008/0052812 | A1 | 3/2008 | Jensen | |
| 2008/0271233 | A1 | 11/2008 | Han | |
| 2009/0144888 | A1* | 6/2009 | Han | E03D 1/306<br>251/298 |

* cited by examiner

ADJUSTABLE FLUSH VALVE POPPET ASSEMBLY

This application claims benefit of U.S. provisional app. No. 62/893,683, filed Aug. 29, 2019, the contents of which are hereby incorporated by reference.

The disclosure relates to flush valve poppet assemblies for a toilet tank, wherein the poppet assemblies are configured to be adjustable in order to provide for multiple flush volumes.

BACKGROUND

Toilets generally incorporate three systems that work together to perform the flushing action: the bowl siphon, the flush mechanism and the refill mechanism. Working in concert, these three systems provide the flushing function of the toilet. Typically, a tank, positioned over the back of a toilet base and behind the bowl, holds water that is used to initiate siphoning from the bowl to a sewage line, after which fresh water refills the bowl. When a person desires to flush a toilet, he or she depresses a flush lever on a tank exterior, which is connected on a tank interior to a movable chain or lever. Upon depression, the flush lever moves a chain or lever, thereby lifting and opening a flush valve and causing water to flow from the tank to the bowl to initiate a toilet flush cycle. Once the tank is emptied of its contents during a flush, the flush valve closes, and a floating mechanism which has now dropped in the tank to some residual level initiates opening of a fill valve. The fill valve provides fresh water to both the tank and the bowl through separate flows. The tank fills with water to a high enough level to cause the float to rise, closing the fill valve, and completing a flush cycle.

Excessive consumption of potable water remains a dilemma for the world population, water agencies, commercial building owners, homeowners, residents and sanitaryware manufacturers. An increasing global population places a strain on the amount and quality of suitable water. In response to this global dilemma, many local and federal authorities have enacted regulations that reduce the water demand required by toilet flushing operations. In the United States, for instance, government agencies that regulate water usage have gradually reduced the threshold for fresh water use in toilets, from 7 gallons/flush (prior to the 1950s) to 5.5 gallons/flush (by the end of the 1960s) to 3.5 gallons/flush (in the 1980s). The National Energy Policy Act of 1995 now mandates that toilets sold in the United States can only use 1.6 gallons/flush (6 liters/flush). High-efficiency toilets that use 1.28 gallons per flush (gpf) or less can be certified under the EPA's WaterSense program.

While a 1.28 gpf is desirable, there are some situations that require the greater flushing power that a 1.6 gpf provides. A challenge water conservation innovators face is to provide an ability to convert a 1.28 gpf flush valve assembly to a 1.6 gpf flush valve assembly, and vice versa, without altering a fill valve and a predetermined volume of tank water. Such conversion must be reliable in both configurations, or there may be risk of valve failure and defeat of any water conservation effort. Seal leakage may be a mode of such failure, so each configuration should allow for component maintenance to replace a seal, for example.

There is a need for a reliable water conservation flush valve assembly that is interchangeable from a 1.6 gpf assembly to a 1.28 gpf assembly or other configuration. Such assembly should also allow for component maintenance. Having an ability to maintain a same tank water level and same components, while being able to provide different flush volumes is highly desirable.

SUMMARY

Accordingly, disclosed is a poppet assembly for a toilet tank flush valve assembly, the poppet assembly comprising an upper float and a lower float, wherein, the lower float is removably attached to the upper float, and a buoyancy of the poppet assembly is dependent on a size and/or shape of the removable lower float.

Also disclosed is a modular poppet assembly system for a toilet tank flush valve assembly, the modular system comprising a first float portion; and two or more second float portions; wherein, the first float portion is configured to removably attach to each of the two or more second float portions to form two or more poppet assemblies, each of the two or more poppet assemblies comprise a different buoyancy, each of the two or more poppet assemblies allow the toilet tank to fill to substantially a same water volume, and as the poppet assembly buoyancy increases, an increase in flush volume is provided.

In some embodiments, disclosed is a system that allows for reconfiguration of a flush valve from a lower flush volume to a higher flush volume without changing the level of water in a toilet tank when full. In some embodiments, the system comprises a first float portion and a plurality of (two or more) second float portions. In some embodiments, the first float portion is configured and arranged to removably couple to each of the plurality of second float portions to form a plurality of float configurations. In some embodiments, each of the plurality of float configurations comprises a different float volume or buoyancy. In some embodiments, as float volume or buoyancy increases, each of the plurality of float configurations are configured and arranged to provide an increase in fluid volume per flush.

In some embodiments, a larger float volume or buoyancy forces the flush valve to stay open longer. According to some embodiments, a change in buoyancy causes the valve to close at different water levels within the tank. In some embodiments, a level of water remains above the valve during the flush. In some embodiments, the water level remaining above a lower volume float configuration is higher than in a lower volume float configuration when the flush is complete. In some embodiments, water level remaining in the tank after a flush corresponds to the amount of fluid removed from the tank per flush cycle.

To accomplish a longer flush valve open time, in some embodiments, a first float portion comprises a first float sidewall and a first float surface, and each of a plurality of second float portions comprise a second float sidewall with a second float sidewall edge. According to some embodiments, each one of said plurality of float configurations are formed by coupling the first float sidewall to one of the second float sidewalls, where for each of the plurality of float configurations, float volume increases as a distance between the first float surface and the second float sidewall edge increases. In some embodiments, an increase in distance is away from the top of the fluid surface when the tank is in a filled state, resulting in a longer flush valve and/or fill valve open time. In some embodiments, each of the second float sidewalls extend substantially perpendicularly away from the first float surface toward the bottom of the toilet tank. According to some embodiments, an opening can be used to remove material from the second float to decrease a volume of air. In some embodiments, an opening is positioned at a lowest point in the float configuration so that water does not enter the void defining an inner volume of the float.

In some embodiments, a larger float volume does not require a change in a fluid level in the tank. In some embodiments, any one of a plurality of second float portions is contained within an inner volume of a main valve body when the toilet tank fluid level is full and/or the flush valve system is in a closed state. In some embodiments, a first float portion is within an inner volume of a main valve body when the toilet tank fluid level is full and/or the flush valve system is in a closed state. In some embodiments, a first float portion is exposed to the tank fluid in a closed state. In some embodiments, the first float portion area that is exposed to the tank fluid remains constant in the plurality of float configurations.

According to some embodiments, in a modular flush valve system a first float portion comprises a first fastener. In some embodiments, each of a plurality of second float portions comprises a second fastener. In some embodiments, the first fastener is configured and arranged to couple with each of the second fasteners. In some embodiments, each of the second fasteners are configured and arranged to rotatably couple to the first fastener. In some embodiments, the first fastener comprises one of a tab or hole, each of the second fasteners comprise the other of a tab or hole, and the tab or hole of the first fastener is configured and arranged to couple with the other tab or hole of the second fastener.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1:
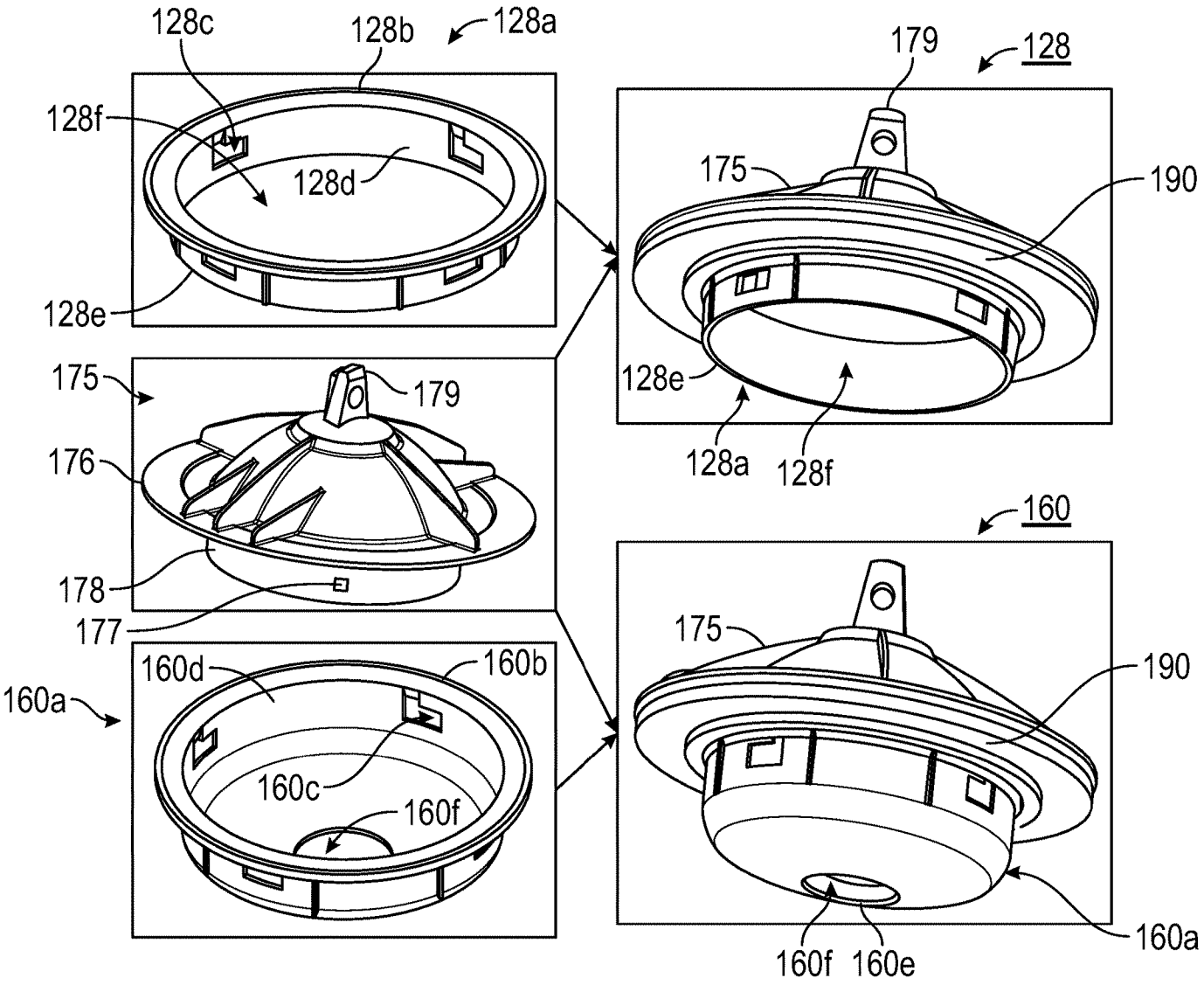
FIG. 1 provides views of poppet assemblies and poppet assembly parts for a toilet tank flush valve, according to some embodiments.

FIG. 1 illustrates 1.28 gpf and 1.6 gpf poppet assembly configurations 128 and 160, respectively, according to some embodiments. Lower float 128*a* comprises rim 128*b*, tab hole 128*c*, sidewall 128*d*, lower sidewall edge 128*e*, and lower opening 128*f*. Lower float 160*a* comprises rim 160*b*, tab hole 160*c*, sidewall 160*d*, lower sidewall edge 160*e*, and lower opening 160*f*.

Upper float 175 comprises upper float surface 176, tab 177, sidewall 178, and connection feature 179. To prepare poppet assemblies 128 and 160, seal 190 is placed between upper float surface 176 and lower float rim 128*b* or 160*b*, and lower float sidewalls 128*d* or 160*d* are rotated relative to upper float sidewall 178 to align and insert tabs 177 in holes 128*c* or 160*c*. Lower float 160*a* provides a larger air void below upper float 175 and thereby a greater buoyancy. Lower float 160*a* provides a larger distance from upper float surface 176 to lower float sidewall edge 160*e*, than does lower float 128*a* from upper float surface 176 to lower float sidewall edge 128*e*. This, together with a smaller lower opening 160*f* vs. 128*f*, thereby trapping air below upper float 175, provides a greater buoyancy.

Assembly 128 may provide for a flush volume of about 1.28 gpf, and assembly 160 may provide for a flush volume of about 1.6 gpf during a flush cycle, respectively. This may be accomplished with an identical toilet water tank holding a substantially identical volume of water filled to a substantially same water level.

Figure 2A:
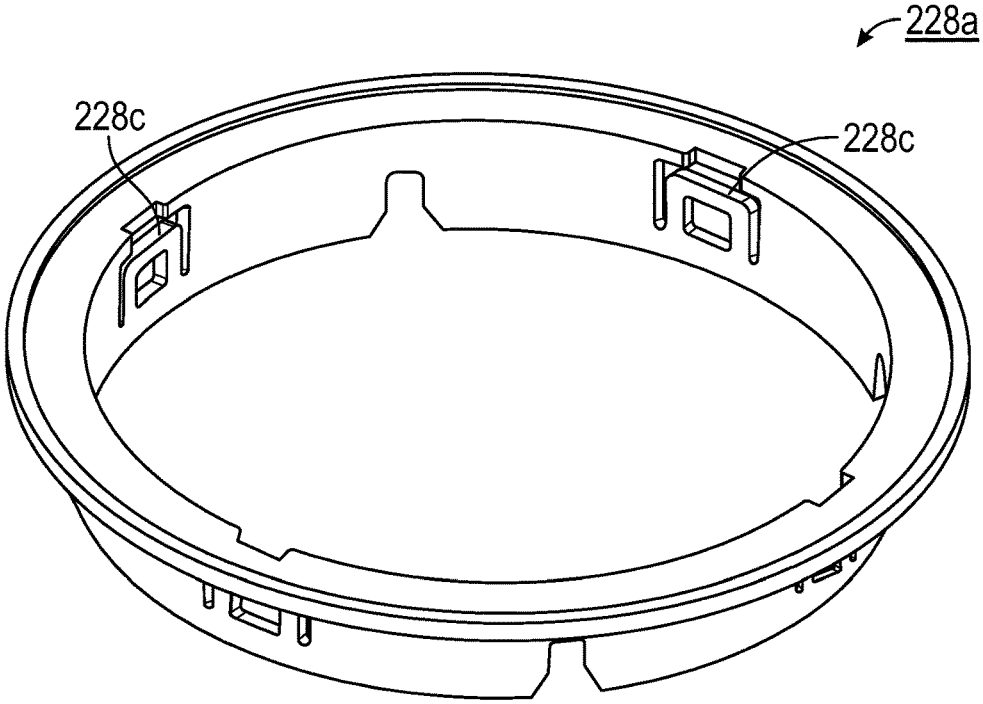
FIG. 2A and FIG. 2B shows views of lower floats, according to some embodiments.
Figure 2B:
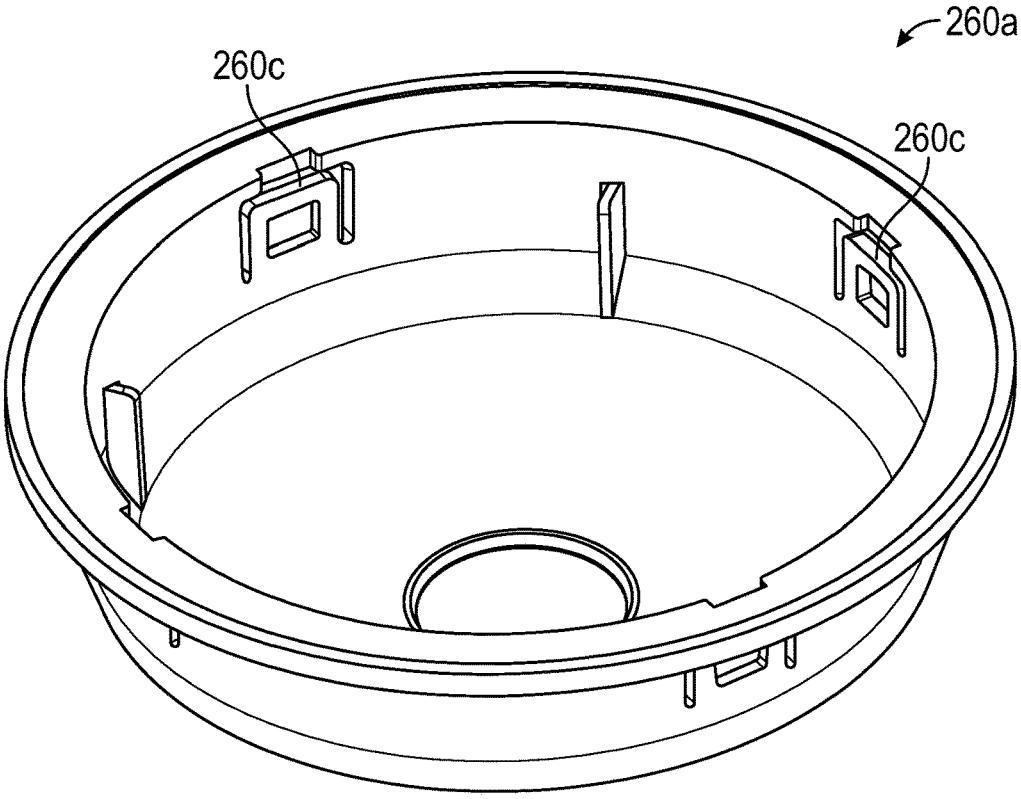

FIG. 2A and FIG. 2B show lower floats 228*a* and 260*a*, respectively, according to some embodiments. Lower float 228*a* may be coupled to an upper float to provide a flush volume of about 1.28 gpf and lower float 260*a* may be coupled to a same upper float to provide a flush volume of about 1.6 gpf. This may be accomplished with an identical toilet water tank holding a substantially identical volume of water filled to a substantially same water level. Lower floats 228*a* and 260*a* contain turn-and-lock tabs 228*c* and 260*c*, respectively. Tabs 228*c* and 260*c* are configured to mate with and couple to complimentary protrusions on an upper float upon twisting lower floats 228*a* and 260*a* onto an upper float.

In some embodiments, a typical toilet tank can include a fill valve that can connect to an inlet fluid supply, a flush valve that fluidly connects the tank to a toilet bowl, and a lever arm that can attach to the tank and can connect to a chain of the flush valve. In some embodiments, pressing the lever arm to flush the toilet can pull the chain of the flush valve upward to lift a poppet assembly and open the valve. In some embodiments, the speed of closing the valve may depend on an air volume contained under an upper float. In some embodiments, air volume affects a buoyant force acting on the float. In some embodiments, a buoyant force determines the flush fluid volume exiting the tank through the flush valve. In some embodiments, when a desired flush volume is about 1.28 gpf the float volume is less than an about 1.6 gpf configuration. In some embodiments, when the float volume is less the valve closes faster and allows less fluid to flush, resulting in a higher water level remaining in the tank after the flush. In some embodiments, when the flush volume is about 1.6 gpf, the float volume is greater and the valve takes more time to close which allows more fluid to pass through the flush valve. In some embodiments, the buoyant force is countered by the weight of the float by some ratio. In some embodiments, the buoyant force is overcome by the float weight and the float configuration begins to fall before water level reaches a top of the upper float. In some embodiments, the float configuration provides enough buoyancy to allow water level to fall below at least a portion of the upper float. In some embodiments, the float configuration provides enough buoyancy to allow water level to fall below at least a portion of both an upper float and lower float before succumbing to the weight of the float configuration. In some embodiments, the altered volume of the float may be hidden within the main valve body in a closed state, which facilitates the system allowing for a greater flush volume without changing the water level in the tank. In some embodiments, a flush volume of about 1.0 gpf or less can be achieved with a similar float component change. According to some embodiments, any flush volume can be achieved using the system.

In some embodiments, during assembly, a tab hole of a lower float may engage a tab integral with an upper float. In other embodiments, a tab of a lower float may engage a tab hole of an upper float. In some embodiments, an inner lower float sidewall may engage an outer upper float sidewall. In other embodiments, an outer lower float sidewall may engage an inner upper float sidewall. A lower float may lock in place as it is twisted onto an upper float. In some embodiments, assembly may include compression of a flexible seal. In some embodiments, compression applied to a seal as an upper and lower float are locked into place prevents fluid leaks to an interior of the poppet assembly. In some embodiments, a lower float comprises an upper rim that may serve to hold a seal in place against an upper float surface.

A seal may be flexible, and may comprise a rubber, an elastomer, a silicone, and the like. In other embodiments, a seal may be semi-flexible or rigid. A seal may be an essentially planar element. In some embodiments a seal may be substantially annular and comprise an outer diameter of from any of about 3.0 inches, about 3.2 inches, about 3.4 inches, about 3.6 inches, about 3.8 inches, about 4.0 inches, or about 4.2 inches, to any of about 4.4 inches, about 4.6 inches, about 4.8 inches, about 5.0 inches, or more.

In some embodiments, removable attachment of a lower float to an upper float, or "swapping-out" a higher flush volume lower float for a lower flush volume lower float, or vice-versa, may be accomplished without the use of any tools.

In other embodiments, other fastener arrangements may allow for removable coupling of an upper float to a lower float and to hold a seal in place, for example, compression pins/holes, pins/slots, notches/slots, and the like. In some embodiments, assembly of a poppet assembly may require a "twist-and-lock" action, in other embodiments, a lower float and an upper float may simply be coupled together without any twist action.

In some embodiments, a size and shape of a lower float is determinate of a buoyancy of the poppet assembly, and the buoyancy of the poppet assembly is determinate of the flush volume. In some embodiments, one or more lower openings of a lower float provides for an air void below an upper float. A size and/or shape and/or position of the one or more lower openings may determine a size of an air void of a poppet assembly which may determine a poppet assembly buoyancy.

The poppet assemblies are suitable for gravity-type flush valve assemblies designed for toilets and toilet assemblies having a toilet tank for gravity/siphon-based flushing. Poppet assemblies may be formed of a polymeric material, such as a moldable thermoplastic. A seal of a poppet assembly is configured to be seated on and enclose a flush valve inlet in a closed position. A poppet assembly is configured to lift from a flush valve inlet upon initiation of a flush cycle, opening the flush valve to provide flush water to a toilet bowl.

In some embodiments, a stem guide, or guide rod, may be reversibly coupled to an upper float and/or a lower float. Coupling may be via a threaded connection, snap-fit connection, adhesive, weld, or other mechanical connection.

In some embodiments, disclosed is a modular flush valve system for providing a substantially same fluid level in a toilet tank after a float volume modification, the modular flush valve system comprising a stem comprising an upper stem protrusion and a lower stem protrusion; wherein at least one of the upper stem protrusion and the lower stem protrusion are configured and arranged to deform upon compression; and wherein the deformation of the at least one of said protrusions is configured and arranged to allow the release of said stem from said stem guide.

In an embodiment, at least one of the upper stem protrusion and the lower stem protrusion comprises a deformable tab; and wherein the deformable tab is configured and arranged to release the stem from a coupled state to an uncoupled state.

In some embodiments, a flush valve assembly is in operable communication with a flush actuation means. A flush actuation means may comprise a flush handle or lever operable by a user from a first rest position corresponding to a flush valve closed position, to a second position, corresponding to a flush valve open position.

A toilet water tank may be configured to maintain substantially one water level or water volume, regardless of a desired flush volume. A removably attached lower float may be configured to determine a desired flush volume.

Some flush valve assemblies are disclosed for example in U.S. Pat. No. 8,079,095, the disclosure of which is hereby incorporated by reference.

It is understood that the invention is not limited in its application to the details of construction and the arrangement of components set forth in the previous description or illustrated in the drawings. The invention is capable of other embodiments and of being practiced or of being carried out in various ways. Therefore, embodiments of the invention are not limited to toilet applications, as those of ordinary skill would realize the benefits of a controlled fluid delivery in other environments.

Also, it is understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. In some embodiments, "substantially" can include a difference of 10% or less of the same unit and scale of that being measured. In an embodiment, "substantially" can include a difference of 5% or less.

Some embodiments of the invention are presented with specific values and/or set points. These values and set points are not intended to be limiting, and are merely examples of a higher configuration (e.g., about 1.6 gpf) versus a lower configuration (e.g., about 1.28 gpf) and are intended to help those of ordinary skill make and use the invention. Embodiments of each valve configuration can fall within any value range specific to a user application as would be recognized by those of ordinary skill.

The previous discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The previous detailed description is to be read with reference to the figures, in which like elements in different figures may have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Features described in connection with one embodiment of the disclosure may be used in conjunction with other embodiments, even if not explicitly stated above.

Embodiments of the disclosure include any and all parts and/or portions of the embodiments, claims, description and figures. Embodiments of the disclosure also include any and all combinations and/or sub-combinations of embodiments.

The term "coupled" may mean that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" means for example configured for liquid or gas flow there through and may be synonymous with "fluidly coupled". The terms "upstream" and "downstream" indicate a direction of gas or fluid flow, that is, gas or fluid will flow from upstream to downstream.

The term "towards" in reference to a of point of attachment or a location, may mean at exactly that location or point or, alternatively, may mean closer to that point or location than to another distinct point or location, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean a 90° perpendicular angle may mean "about 90°". The term "generally" may be equivalent to "substantially".

The invention claimed is:

1. A modular poppet system for a toilet tank flush valve assembly, the modular poppet system comprising an upper float, first lower float, and a second lower float, wherein, the first lower float and the second lower float are configured to be removably attached to the upper float to provide a first poppet assembly and a second poppet assembly, respectively, the first poppet assembly comprises a first buoyancy and the second poppet assembly comprises a second buoyancy, the upper float comprises an upper float surface configured to receive a seal, the upper float comprises an upper float sidewall extending from the upper float surface, the first lower float and the second lower float each comprise a lower float sidewall configured to removably couple with the upper float sidewall, the first lower float and the second lower float each comprise an opening defining a lower sidewall edge, the second poppet assembly comprises a larger distance between the upper float surface and the lower sidewall edge than the first poppet assembly, the distance measured vertically from the upper float surface to the lower sidewall edge, the second buoyancy is greater than the first buoyancy, and the first poppet assembly is configured to provide for a first flush volume, and the second poppet assembly is configured to provide for a second flush volume.

2. The modular poppet system according to claim 1, comprising the seal, the seal configured to be positioned between the upper float and the first lower float and the second lower float.

3. The modular poppet system according to claim 2, wherein the flexible seal is substantially annular and comprises an outer diameter of from about 3.0 inches to about 5.0 inches.

4. The modular system according to claim 2, wherein the seal is flexible.

5. The modular system according to claim 2, wherein the seal is semi-flexible or rigid.

6. The modular poppet system according to claim 1, wherein the first flush volume and the second flush volume are provided with a substantially equivalent toilet tank water volume.

7. The modular poppet system according to claim 6, wherein the first flush volume is about 1.28 gpf and the second flush volume is about 1.6 gpf.

8. The modular poppet system according to claim 1, wherein the first poppet assembly and the second poppet assembly allow the toilet tank to fill to substantially a same water volume.

9. The modular poppet system according to claim 1, wherein removable attachment is achieved via rotatably coupling the upper float sidewall to the lower float sidewall.

10. The modular poppet system according to claim 9, wherein the upper float comprises one or more upper float fasteners, the first lower float and the second lower float comprise one or more lower float fasteners, and the upper float fasteners are configured to be received by and couple to the lower float fasteners.

11. The modular poppet system according to claim 10, wherein the upper float fasteners comprise tabs or holes, and the lower float fasteners comprise corresponding holes or tabs.

12. The modular poppet system according to claim 1, wherein the poppet assembly buoyancy increases as the distance between the upper float surface and the lower float sidewall edge increases.

13. The modular poppet system according to claim 1, wherein the first lower float opening and the second lower float opening are positioned towards a lower end of the first lower float and the second lower float, respectively.

14. The modular poppet system according to claim 1, wherein the first poppet assembly comprises a different size and shape than the second poppet assembly.

15. The modular system according to claim 1, wherein the second poppet assembly is configured to provide a greater flush volume than the first poppet assembly.

* * * * *